US005851170A

United States Patent [19]

Howell

[11] Patent Number: 5,851,170

[45] **Date of Patent: *Dec. 22, 1998**

[54] CENTRIFUGE WITH CAM SELECTABLE ROTATIONAL ANGLES AND METHOD FOR UNLOADING SAME

[75] Inventor: Gary Wayne Howell, Elkton, Md.

[73] Assignee: Dade Behring Inc., Deerfield, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 641,310

[22] Filed: Apr. 30, 1996

[51] Int. Cl.[6] ..... B04B 5/02

[52] U.S. Cl. ..... 494/20

[58] Field of Search ..... 494/1, 7, 10, 12, 494/16, 20, 33, 47, 84

[56] References Cited

U.S. PATENT DOCUMENTS

| | | | |
|---|---|---|---|
| 2,507,309 | 5/1950 | Larsson . | |
| 3,420,437 | 1/1969 | Blum et al. | 494/20 |
| 3,951,334 | 4/1976 | Fleming et al. . | |
| 4,010,893 | 3/1977 | Smith et al. . | |
| 4,344,563 | 8/1982 | Romanauskas . | |
| 4,431,423 | 2/1984 | Weyant, Jr. | 494/20 |
| 5,045,047 | 9/1991 | Hutchins et al. | 494/20 X |
| 5,178,602 | 1/1993 | Wells | 494/20 X |
| 5,584,790 | 12/1996 | Bell et al. | 494/20 |

FOREIGN PATENT DOCUMENTS

| | | | |
|---|---|---|---|
| 0 002 270 A | 6/1979 | European Pat. Off. . | |
| 564834 | 10/1993 | European Pat. Off. | 494/20 |
| 3512848 | 10/1985 | Germany | 494/20 |
| WO 81/01255 | 5/1981 | WIPO . | |

OTHER PUBLICATIONS

Centrifugation Process Research Disclosure 17024, pp. 20–21, Jun. 1978.

*Primary Examiner*—Charles E. Cooley
*Attorney, Agent, or Firm*—Leland K Jordan

[57] ABSTRACT

A centrifuge and method of operation as a fixed angle or swinging angle centrifuge. A pair of cams cooperate with the centrifuge drive shaft to engage and maintain the buckets at a fixed angle. Tubes are automatically unloaded by moving a bracket away from the lower end of a bucket so that the tube drops from the bucket. When the cams are disengaged from the buckets, the buckets are allowed to swing freely.

9 Claims, 6 Drawing Sheets

FIG.6
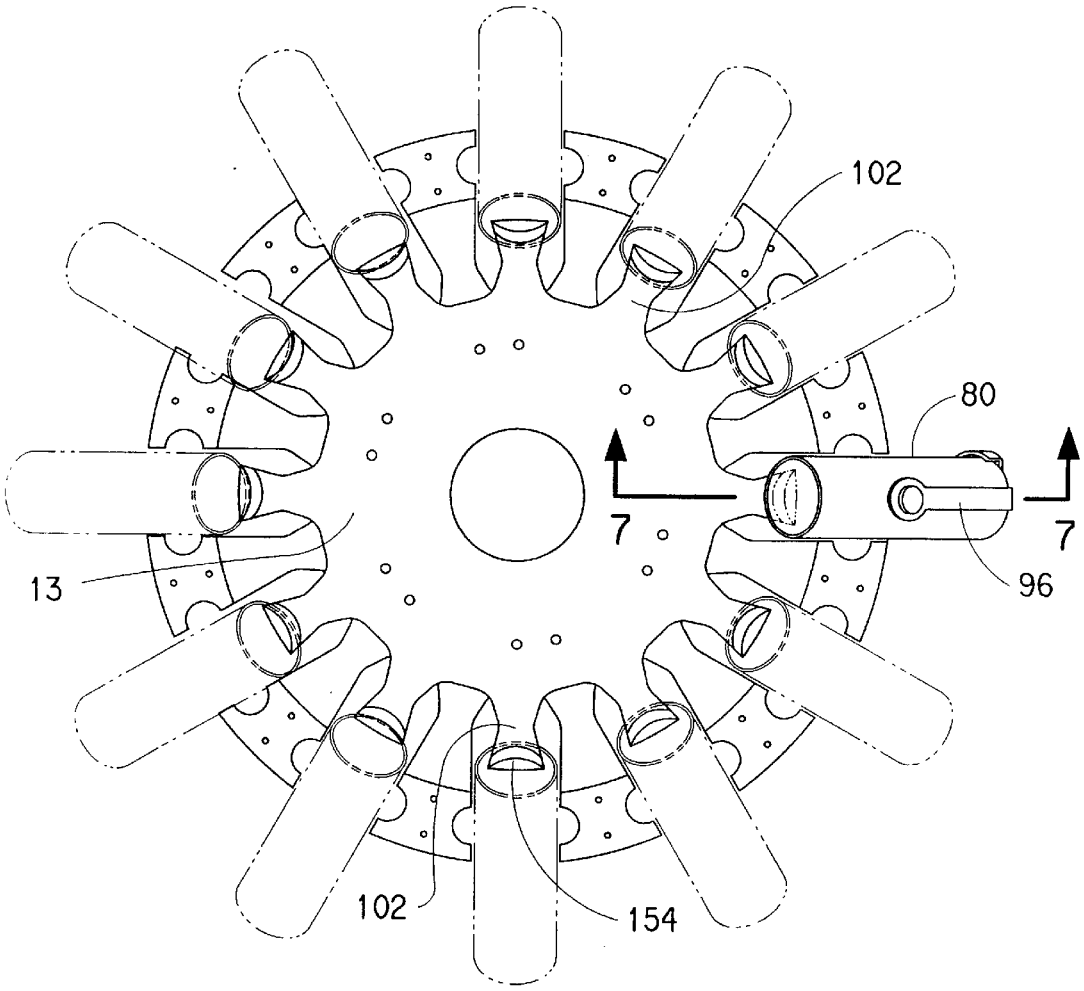
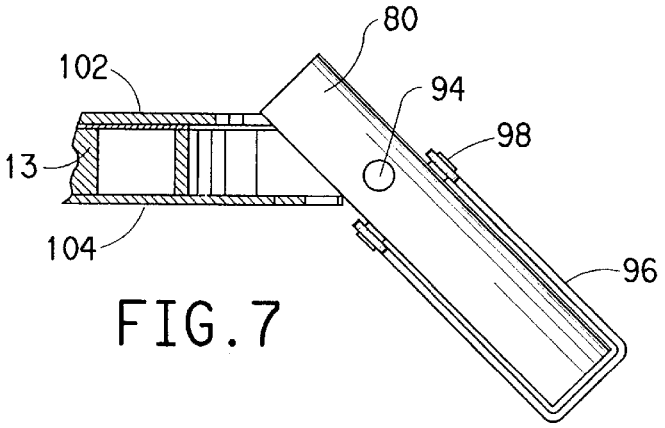
FIG.7

CENTRIFUGE WITH CAM SELECTABLE ROTATIONAL ANGLES AND METHOD FOR UNLOADING SAME

CROSS REFERENCE TO RELATED APPLICATIONS

This invention is related to an invention described and claimed in copending application entitled APPARATUS AND METHOD FOR STABILIZING A CENTRIFUGE ROTOR, filed Apr. 30, 1996, Ser. No. 08/640,391.

This invention relates to a centrifuge in which the user can select the angle at which the tubes, holding specimens for samples, are centrifuged.

BACKGROUND OF THE INVENTION

Often when preparing whole blood specimens in the clinical laboratories, these specimens are centrifuged in order to separate the blood into its constituent(s). A centrifuge is an apparatus for subjecting a sample of a material to a centrifugal force in order to separate by density this sample into its constituent components. A common use for a centrifuge is in a clinical analytical laboratory where blood obtained from a patient is separated by centrifical force into red cells and plasma components. The centrifuge includes a rotating member, or rotor, mounted on a gyro for high speed rotational movement usually with a stationary protective casing. The rotor may be outfitted with buckets or cavities which carry the sample to be separated during exposure to the centrifical force.

Clinicians can presently choose between swinging bucket and fixed angle rotors for centrifugation. Swinging bucket rotors are well known. These rotors are typified by a central hub portion having arms radiating outwardly therefrom. The radially outward ends of the arms are typically somewhat enlarged to define a support portion adapted to receive the trunions support pins on which the buckets are carried. The lateral surfaces of the enlarged support portion extends substantially vertically or parallel to the axis of rotation of the rotor. The trunion pins are received in bores extending into the enlarged support portion. The axis of the pins on confronting surfaces of angularly adjacent arms are coplanar and extend outwardly or extend toward each other along a substantially cordal line. Onto confronting pairs of these trunion pins are mounted the swinging buckets which receive a container or tube carrying the sample to be centrifuged. When the rotor is at rest the buckets depend vertically downward from the trunion pins so that the axis of the bucket is substantially parallel to the rotational axis of the rotor. When the rotor is brought up to operational speed, however, the buckets pivot outwardly about the trunion pins and swing radially outwardly under the influence of centrifical force. That is, during operation, the axis of the bucket is substantially perpendicular to the rotational axis of the rotor.

Swinging bucket rotors have the advantage of positioning the thixotropic gel barrier used in such rotors at a right angle to the tube axis when the tube is oriented perpendicular to the spin axis. They also allow the use of non-gel collection tubes by suspending rotation with the tube aligned to the spin axis. This is an advantage as gel increases costs and is thought to be inconsistent with some methodologies.

Fixed angle rotors, i.e., those in which the tubes are held in a position of a fixed angle, typically 45°, relative to the spin axis, are known to separate the liquid or solid phases in less time than swinging bucket rotors with the same gravitational force. This is due to the shortened path lengths of the solid phase to the tube wall and the effects of cell aggregation at the tube wall. Sheer stress increases cause cells to aggregate to smaller units from their normal continuous structure. This effect, termed "rouleaux" or "flocs", thereafter causes a reduction in viscosity and increased cell flow at the tube wall.

The usual centrifuge design requires separate centrifuges: (1) for swinging bucket operation and (2) for fixed angle separations. This is cost and operationally inefficient.

U.S. Pat. No. 4,344,563 describes a centrifuge rotor of the swinging bucket type characterized in that the trunion bores provided in the arms at the radial outward end thereof are arranged such that the axis of the bore provided in one surface of the arm lies above a horizontal plane through the arm and the axis of the bore provided in the other surface the arm lies below the arm and that the bores provided in the confronting surfaces of adjacent arms lie on the same side of the horizontal plane.

U.S. Pat. No. 3,951,334 describes a locking ring having castellations for a swinging bucket type centrifuge. The locking ring is constructed such that the castellations can be angularly positioned relative to the rotor to either block or permit the buckets to swing outwardly during operation. The angular positioning of the castellations relative to the buckets is accomplished by relative angular acceleration and deceleration between the rotor and the locking ring.

U.S. Pat. No. 4,431,423 describes a cell washing apparatus having a pivotally moveable sample tube holder provided with a radially inwardly directed arm having a grasping hook thereon. The hook engages a retaining surface disposed radially inward of the pivot point of the holder to restrain radially outward movement of the sample holder.

None of these prior art centrifuges can operate in both capacities, i.e., fixed angle and swinging bucket.

SUMMARY OF THE INVENTION

This invention overcomes many of these disadvantages of the prior art and provides a centrifuge having a selectable angle, swinging bucket type rotor, said rotor having upper and lower faces and a reversible direction drive shaft, the rotor being mounted on said drive shaft and having a bucket (a) adapted to carry a centrifuge tube, (b) pivotally mounted on the periphery of said rotor, and (c) able to swing upwardly and outwardly during operation of the centrifuge, said centrifuge comprising upper and lower cams positioned rotatably adjacent the respective upper and lower faces of said rotor, said cams being linked to move in unison, said lower cam having a peripheral drive protuberance, said upper cam having a peripheral restraining protuberance corresponding in location to said lower cam, and means to rotate said rotor relative to said cams to align said protuberances (a) to engage said bucket and (b) to disengage said bucket, thereby permitting said bucket to be rotated by said rotor at a selectable angle with respect to the axis of said drive shaft.

In a preferred embodiment, the upper cam restraining protuberance is designed to limit the outward swing of said bucket to about 45° with respect to the axis of rotation of the drive shaft.

In another preferred embodiment of the invention, the centrifuge bucket has (a) an open lower end, (b) a pivoted bracket that covers the lower end of said bucket, thereby to retain said tubes therein, and (c) an activated member for engaging and restraining the bracket, and the centrifuge includes means to rotate said rotor in a first direction and to simultaneously activate said activated member to engage the bracket, thereby to position the bracket away from the lower end of said bucket allowing said tube to drop from said bucket.

The invention is seen to provide centrifuge that is capable of operation in either swinging bucket or fixed angle mode by simply rotating the rotor relative to its upper and lower cams, or a combination of both swing bucket and fixed angle in the same spin sequence. Further, the tubes may be emptied from the bucket simply by allowing the centrifuge to be in its rest position, engaging the bucket release and rotating the rotor slowly to permit the tubes to drop out.

BRIEF DESCRIPTION OF THE DRAWINGS

Several drawings taken in conjunction with the specification will provide a better understanding of this invention. In the drawings, like reference numerals are used for like components, there are the following figures:

FIG. 6 is a pictorial plan view of the centrifuge of FIG. 1 in its fixed angle operation; and FIG. 7 is a sectional view taken along the section lines 7—7 of FIG. 6.

DESCRIPTION OF THE PREFERRED EMBODIMENT

Figure 1:
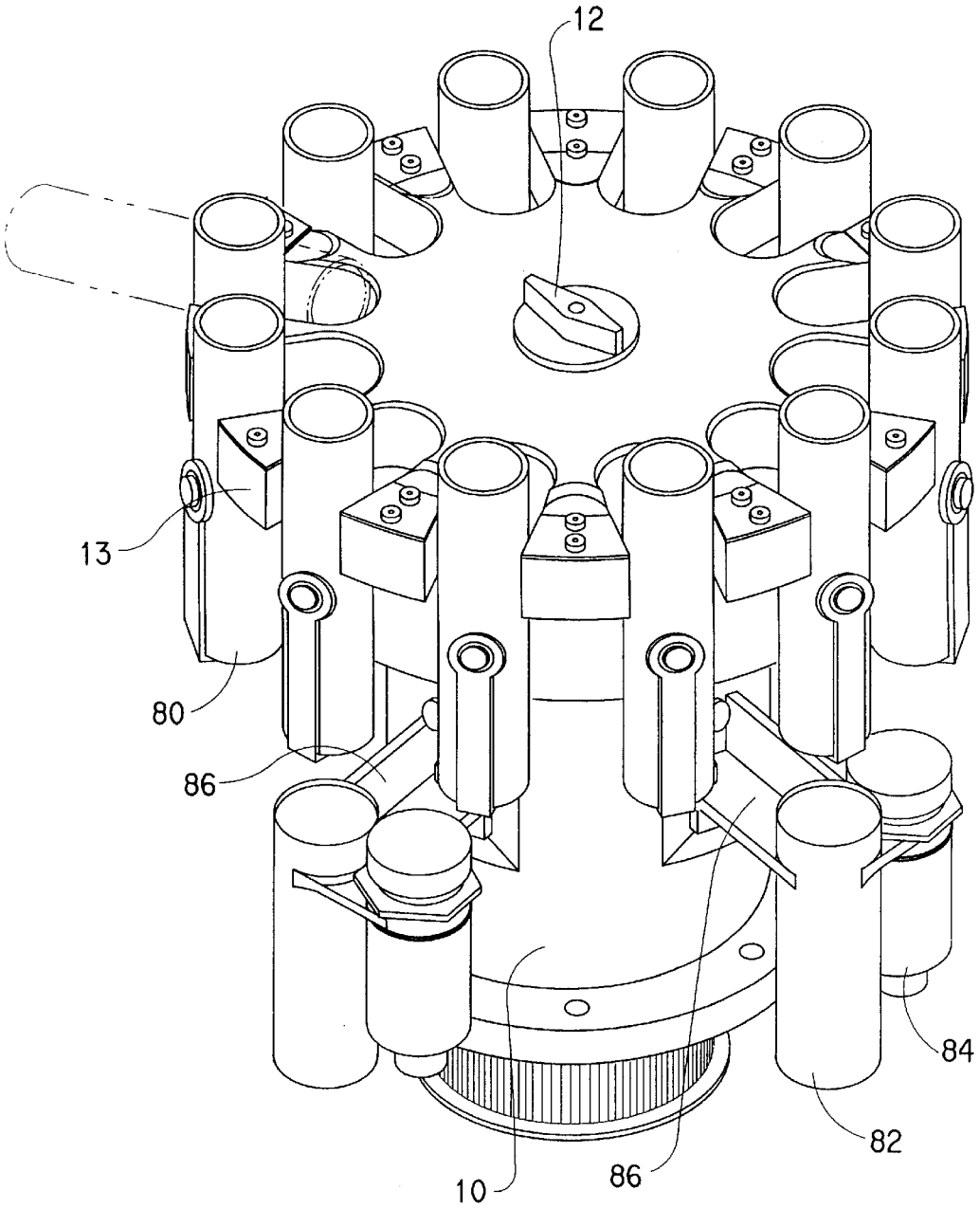
FIG. 1 is a perspective view of a selectable angle, swinging bucket type rotor of this invention.

There may be seen in FIG. 1 a centrifuge constructed in accordance with this invention, which mounts a plurality of buckets 80 on a rotor 13. The rotor 13 is mounted on a housing 10 and secured to an upper drive shaft 11 (FIG. 3) by a knob 12. Mounted to the side of the housing 10 are a tube guide 82 and an attached solenoid 84 both being mounted by the same bracket 86 which is attached to the housing 10.

Figure 2:
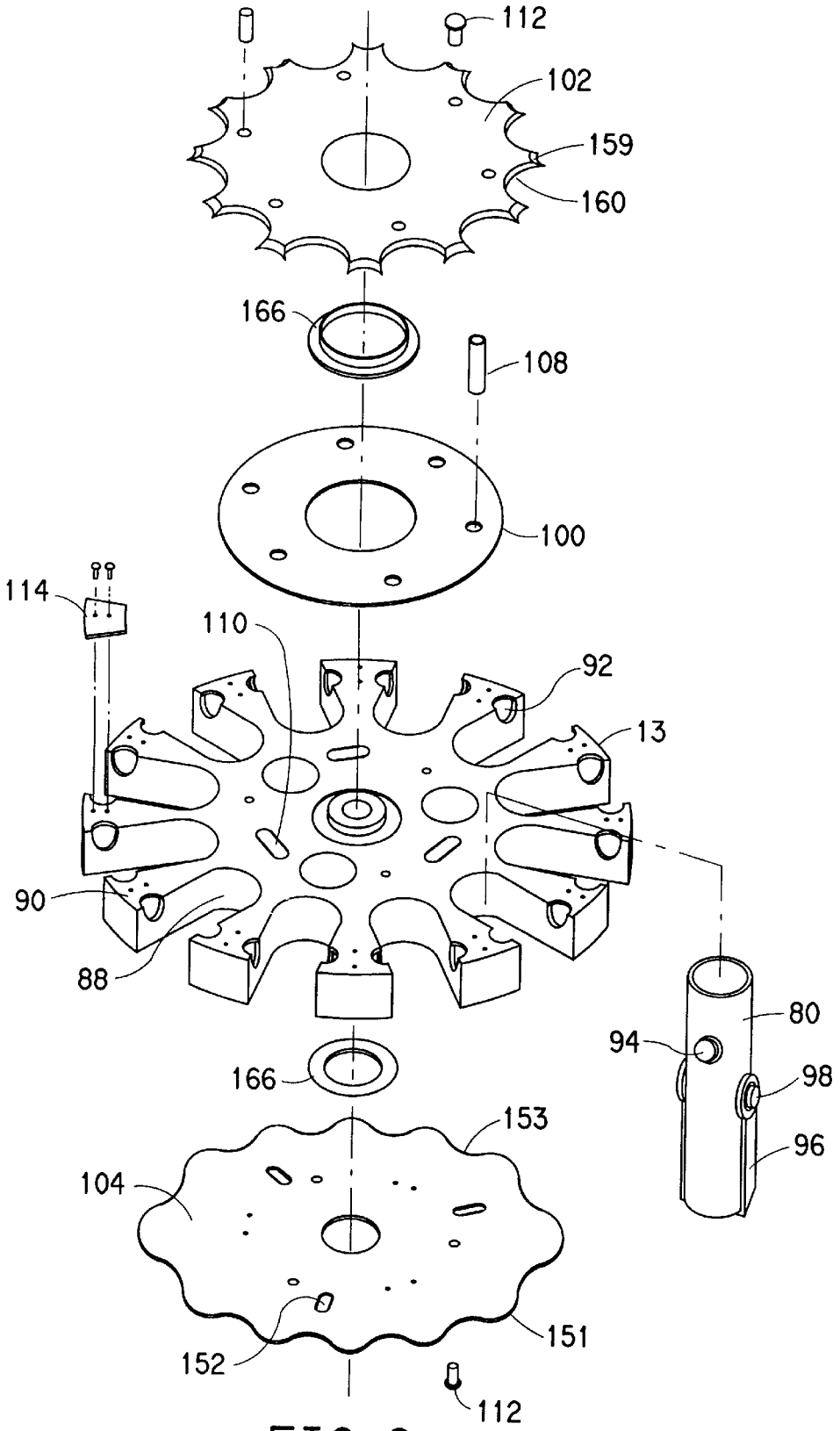
FIG. 2 is an exploded view of the selectable angle rotor illustrated in FIG. 1.

The details of the rotor may be more easily understood with reference to FIG. 2. The rotor is seen to have circumferentially spaced recesses 88 defined by castellations 90. Each castellation has a trunion bore 92 formed in the upper side thereof for receiving a bucket mounting trunion pin 94 for each of the buckets 80. Each of the buckets 80 has a downwardly depending release bracket 96 pivotally mounted on a release trunion pin 98. The release bracket 96 functions to prevent tubes 86 (FIG. 3) positioned in the bucket 80 from falling out of the bucket. Rotor liners 100 are positioned above and below the rotor 13 so as to provide a slidable surface for an upper cam 102 and a lower cam 104. Gaskets 166 aid in mounting the upper and lower cams. A standoff 108 is positioned through each of the standoff slots 110 formed in the rotor 13. Screws 112 pass through the upper and lower cams 102, 104 to engage the standoff 108 and thereby cause the upper and lower cams to operate in unison. A bucket retainer 114, attached to each castellation 90, retains the trunion guide pin 94 for each bucket 80 in the freely swinging position.

Figure 3:
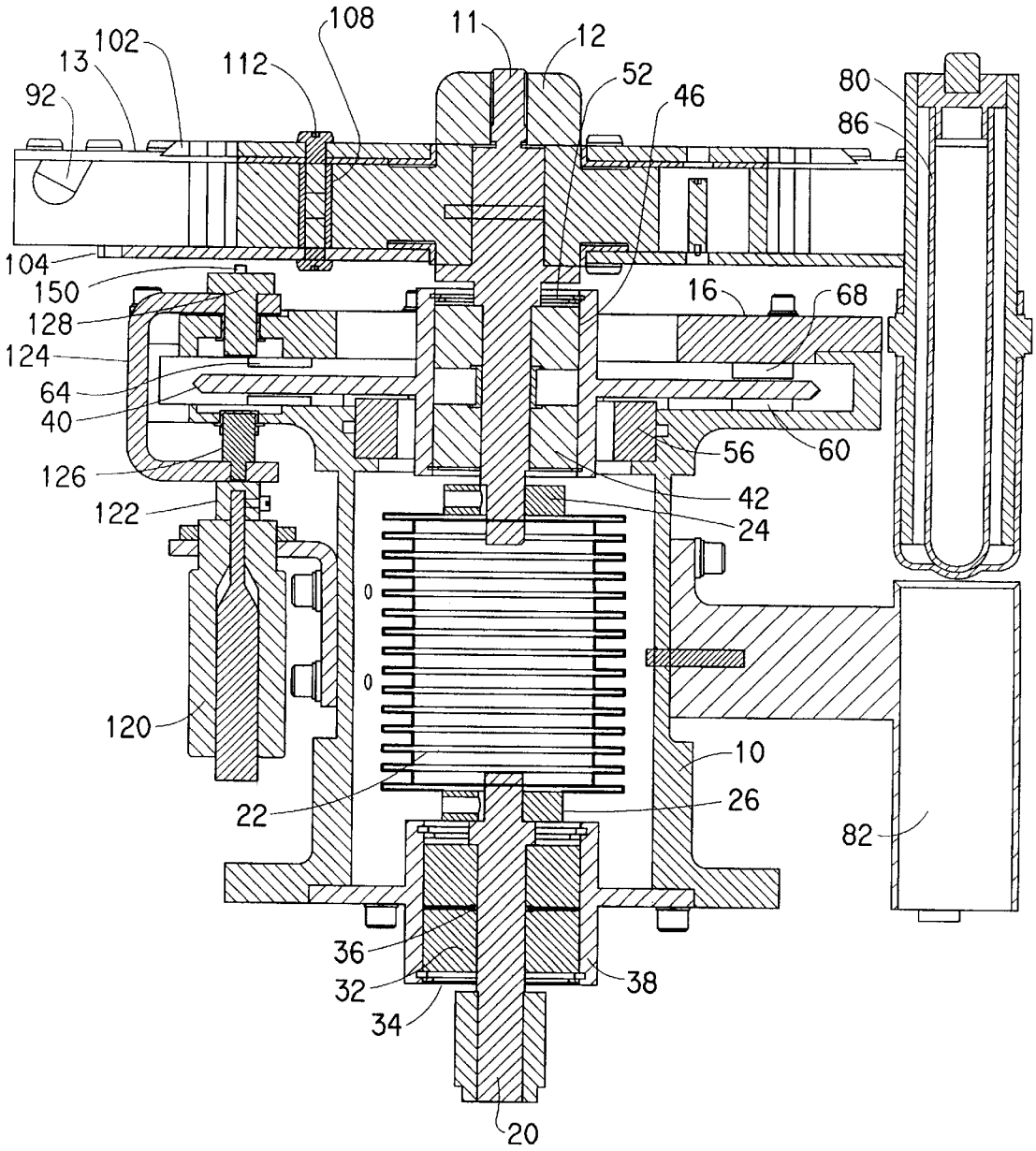
FIG. 3 is a cross-sectional elevation view of the centrifuge rotor depicted in FIG. 1.

Referring now to FIG. 3, the remaining details of the gyro which drives the rotor 13 will be explained. This gyro may be the same as that described in copending application Ser. No. 08/640,391,filed Apr. 30, 1996 entitled Apparatus and Method for Stabilizing a Centrifuge Rotor. The gyro is formed of two shafts, an upper drive shaft 11, as noted, and a lower drive shaft 20, the shafts being coupled together by a flexible coupling 22 which permits relative lateral motion (perpendicular to the axis of rotation of the shafts) between the two shafts. The flexible coupling 22 may be any suitable coupling of this type, one suitable coupling being that manufactured by Servometer Corporation. The flexible coupling 22 has upper and lower end cap mounts 24 and 26, respectively. Each has an end port for accommodating the respective drive shafts 20 and 11. The lower end cap mount 26 has a dowpin (not shown) mounted therein which may be used as a flag for sensing the home position of the rotor shafts. This position is sensed by a suitable transducer 30 (FIG. 5) which observes the position of the flag and may be used in a known manner to control the position of the rotor 13.

The lower drive shaft 20 is secured by suitable ball bearings 32 positioned within a bearing housing 38 by appropriate washers and retaining rings 34. The ball bearings 32 are separated by a suitable spacer bearing 36. The bearing housing 38 is secured to the lower end of the housing 10 by suitable screws.

The upper drive shaft 11 is in the form of a stub, the lower end of which is secured in the upper end cap mount 24 and is positioned within disk bearings 42 which are housed by a bearing housing in the form of a hub 46 to which a disk 40 is integrally formed. The disk 40 preferably is formed of stainless steel and is positioned within the housing 10 having an upper end that is generally cup-shaped and covered by the cap 16. The housing 10 has a counter bore in which is positioned a plastic boss 56 which acts as a bumper to cushion radial movement of the upper drive shaft 11. The disk bearings 42 are secured at either end of the housing 46 by suitable washers and retaining rings 52.

In accordance with this invention, a plurality of restraining means, preferably in the form of lower support sliding bearings 60 are positioned under the disk 40 to support its rotation in a horizontal plane. These lower support bearings 60 are positioned in recesses (not shown) formed in the lower portion of the cap shaped portion of the housing 10, preferably at six equally spaced circumferential positions. Correspondingly, three equally circumferentially spaced upper sliding bearings 64 are positioned in recesses (not shown), formed in the cap 16, which are positioned axially above the corresponding lower support bearings 60. These bearings 64, which may be referred to as restraining bearings 64, are positioned only above three of the lower support bearings 60, allowing room for damping means in the form of solenoid activated sliding bearings 68, which are positioned directly above the remaining, equally circumferentially spaced, support bearings 60.

The solenoid actuated bearings 68 are actuated by a solenoid (not shown), which is countersunk in the cap 16, and operate to actuate a solenoid shaft 72 which is attached to drive the damping bearings 68. The damping bearings 68 may be formed of a suitable material such as Vespel™ synthetic resinous material with graphite having low sliding friction. Correspondingly, the upper restraining bearings 64 may be formed of a suitable material such as Ertalyte™ polyester which also has a low sliding friction. Actually, the sliding bearings may be formed of any suitable material which provides a low sliding friction, such as are: TEFLON™ fluoropolymer, nylon, DELRIN™ acetal copolymer, to name but a few. The upper bearings 64 and 68 are positioned so that in normal operation they either do not contact, or lightly contact, the upper side of the disk 40.

The gyro also includes a cam solenoid 120 mounted on the side of the housing 10 by a suitable bracket, which when activated moves a disk cam 122 to raise a push beam 124 supported and guided by a lower beam pin 126 mounted in the housing 10 and an upper beam pin 128 mounted in the cap 16, on top of which is mounted a drive pin 150. The drive pin 150 engages a drive slot 152 in the lower cam (FIG. 2).

In accordance with this invention, the lower cam 104 (FIG. 2) has a plurality of equally spaced, equally circumferentially spaced, cam drive protuberances 151. The protuberances are spaced at 15 degree intervals (corresponding to the bucket spacing) about the circumference of the lower cam 104. The drive protuberances 151 extend radially outward a sufficient distance so that the lower cam, when properly rotated, will engage the bucket 80 and push it outwardly to a 45 degree angle (other angles may be selected) with the axis of rotation, thereby permitting operation of the centrifuge as a fixed angle centrifuge. In between each protuberance 151 is a recess 153 which extend radially sufficiently to allow the bucket 80, as depicted in FIG. 3, to lie in a vertical direction.

Further, in accordance with this invention, the upper cam 102 is provided with cam castellations 159, which could also be called restraining protuberances, which are circumferentially, equally-spaced, about the circumference of the upper cam 102. Such castellations 159 are positioned every 15° about the circumference of the upper cam 102 and they have an inclined surface lying at a 45 degree angle (for a 45° rotor). This accommodates, as illustrated in FIG. 7, the bucket at a 45 degree angle and prevents it from passing beyond the 45 degree angle. The castellations 159 and protuberances 151 are positioned to be at the same relative circumferential locations when the cams 102 and 104 are in the blocking position.

A recess 160 is formed on the upper cam 102 between each castellation 159 of sufficient depth to permit the buckets 80, when accelerated to swing outwardly, when the upper cam 102 is not in the blocking position, to lie perpendicular to the axis of rotation.

Figure 4:
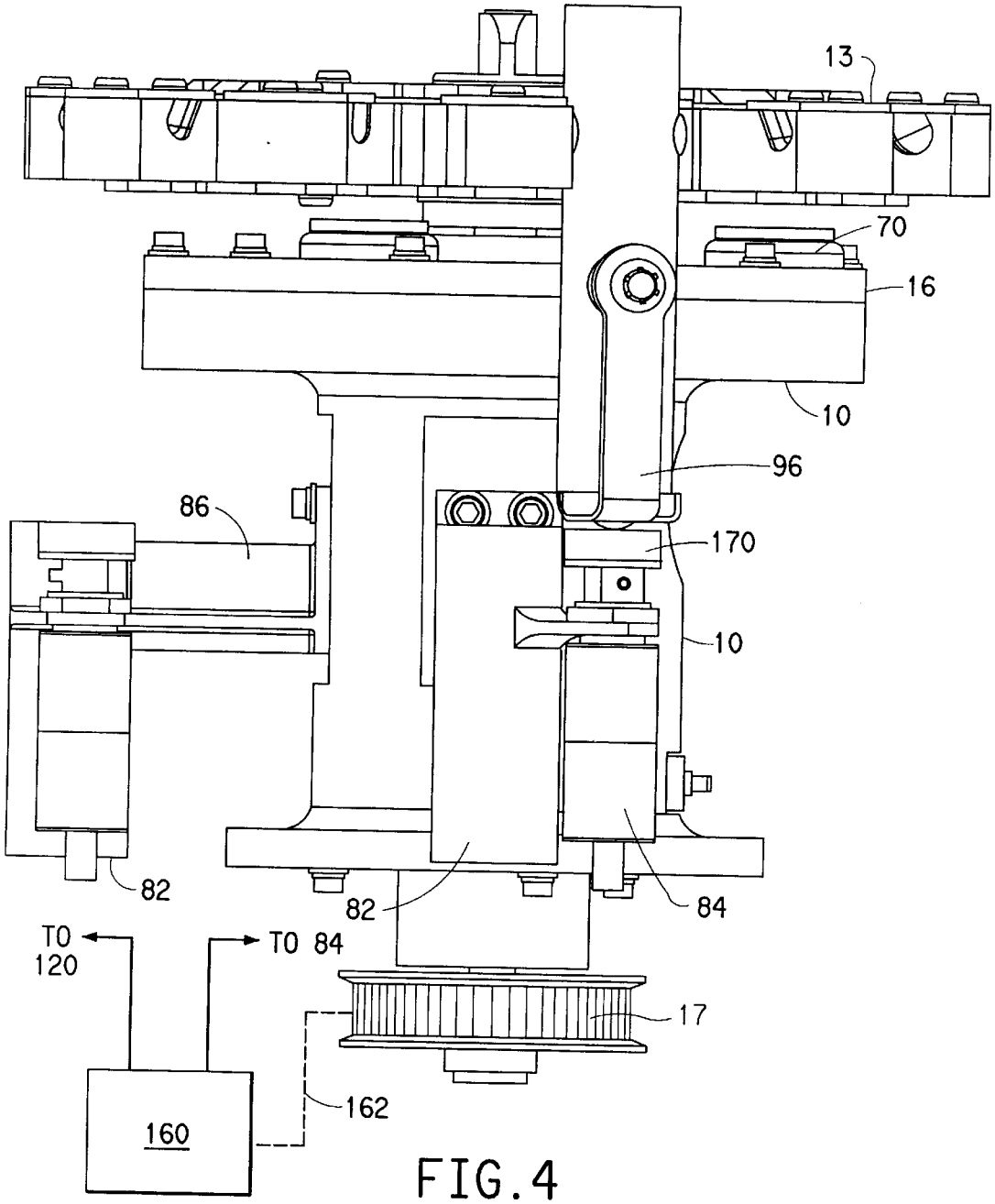
FIG. 4 is an elevation pictorial view of the centrifuge illustrated in FIG. 1 in one phase of its operation.

In operation, the centrifuge is able to operate as a selectable angle centrifuge, i.e., as a swinging bucket centrifuge or as a fixed angle centrifuge. The centrifuge also includes, as depicted in FIG. 4, a conventional drive control 160 which, operating through the drive pulley 162, controls rotor speed and direction of rotation. The drive control 160 also actuates the cam solenoid 120 and the bucket release solenoid 84. The drive control 160 is able to cause the rotor 13 to rotate in incremental bits, i.e., 14.5° as will be explained.

To operate, with the rotor in its normal or home position, the upper cam recesses 160 and the lower cam recesses 153 are positioned in line with the rotor recesses 88. This permits the buckets 80, when the rotor is spun, to freely swing outwardly and upwardly until they assume the conventional swinging bucket position of rotating perpendicularly to the axis of rotation of the centrifuge.

When it is desired to shift to the fixed angle rotor operating in this instance at a 45 degree angle with the axis of rotation (other angles could be selected but 45° is the conventional angle). The drive control 160 activates the cam solenoid 120 which operates to cause the push bracket 124 to move the drive pin 150 into one of the drive slots 152 in the lower cam 104. This stops the movement of both upper and lower cams 102 and 104 and permits the rotor to rotate independently of the cams 102 and 104. The drive pin 150, thus engaging the bottom of the lower cam disk, holds it with the lower and the upper cams with respect to the rotating rotor 13. The drive control 160 rotates the rotor 13 through 14.5° of angular position with respect to the cams and positions the drive protuberances 151 of the lower cam and the castellations 159 of the upper cam over the recesses 88 of the rotor 13. As seen in FIG. 7, the drive protuberances engage the bucket 80 and raise it to a 45 degree angle, the upper cam castellation 159 restraining movement of the bucket beyond the 45 degree angle.

Having repositioned the rotor, the pin 150 is disengaged from the lower cam and the centrifuge may now be operated as a fixed angle rotor. The operation may be returned to swinging bucket type operation, in a similar manner by reengaging the pin with the lower cam and rotating the rotor to reposition the relative position relationship between the upper and lower cams and the rotor. This selection of spin types may be done several times for each sample, if desired.

Figure 5:
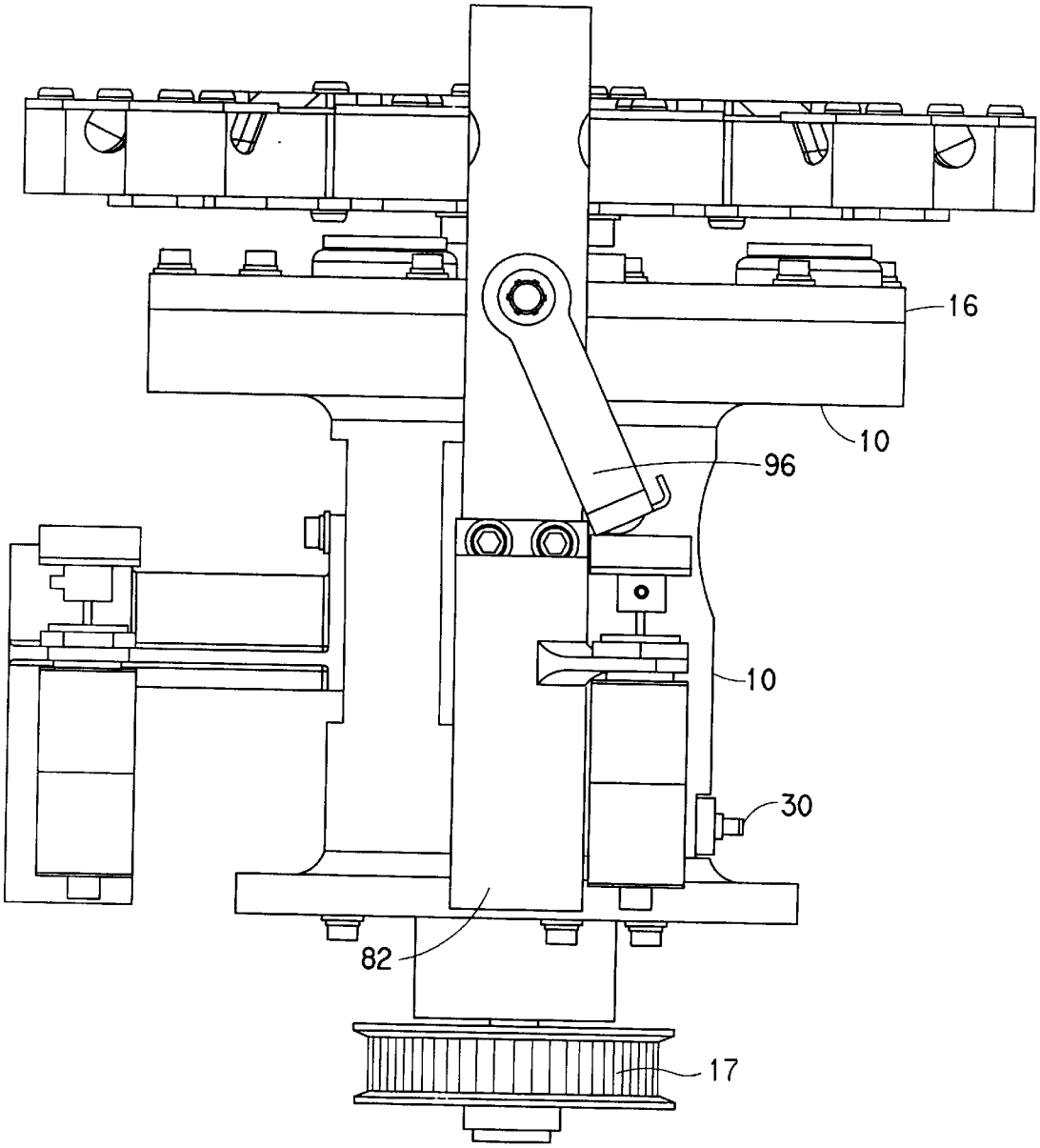
FIG. 5 is an elevation pictorial view of the centrifuge depicted in FIG. 1 in another phase of its operation.

Once the rotor is stopped, whether having run as fixed bucket or swinging bucket centrifuge, the rotor must be returned to its swinging bucket mode so the tubes now hang at their vertical position. According to this invention, the tubes 86 may be automatically released from the buckets. This aspect of the invention is best understood with reference to FIGS. 4 and 5. With the rotor positioned in the swinging bucket mode, the drive control 160 actuates the bucket release solenoid 84. A pad 170, which may be spongelike, is moved slightly upwardly by the release solenoid 84 to the position depicted in FIG. 4 so as to engage firmly the bottom of the release bracket 96. The drive control 160 now rotates the rotor about 15° in a clockwise sense thereby removing the release bracket from being underneath the bucket 80 as depicted in FIG. 5 allowing the solenoid to raise pad 170 to take up the slack provided by the offset release bracket 96. This allows the tube 86 (FIG. 3) within the bucket 80 to fall through the tube guide 82 to a collection device (not shown).

After emptying the bucket, the solenoid 84 is deactivated allowing the pad 170 (FIG. 4) to return to its original position not in contact with the release bracket. The rotor may now be rotated again thereby moving the release bracket 96 to a new position under the bottom of another bucket as depicted in FIG. 4. This sequence may be repeated to unload as many buckets as desired.

I claim:

1. A centrifuge having a selectable angle bucket type rotor, the rotor having upper and lower faces, the centrifuge comprising:

a drive shaft having an axis, the shaft adapted for mounting and rotating the rotor;

drive means for rotating said drive shaft;

at least one bucket adapted to carry a tube, the bucket being pivotably mounted on the periphery of the rotor;

upper and lower cams adjacent the respective upper and lower faces of the rotor and linked to move in unison, the lower cam having at least one peripheral drive protuberance; and, the upper cam having at least one peripheral restraining protuberance;

so that the drive and restraining protuberances engage said at least one bucket whereby the bucket is pivoted at a fixed angle with respect to the axis of the shaft when the rotor is rotated by said drive means in a first direction relative to the cams through a predetermined angular distance.

2. The centrifuge of claim 1 wherein said at least one bucket has (a) an open lower end, (b) a pivoted bracket that covers the lower end of said bucket, thereby to retain said tube therein, and (c) an activating member for engaging and restraining the bracket, said drive means adapted to rotate said rotor in a first direction and to activate said activated member to engage the bracket, thereby to move the bracket away from the lower end of said bucket allowing said tube to drop from said bucket.

3. The centrifuge set forth in claim 2 which also includes a tube guide positioned under said bucket, thereby to guide said tube when it drops from the bucket.

4. The centrifuge of claim 1 wherein rotation of the rotor in a second direction relative to the cams further causes the drive and restraining protuberances to disengage said at least one bucket, so that the bucket is parallel to the axis of the drive shaft.

5. The centrifuge of claim 1 wherein the at least one restraining protuberance is designed to limit the outward swing of said at least one bucket to about 45° with respect to the axis of the drive shaft.

6. The centrifuge of claim 1 wherein the at least one drive protuberance is designed to position the outward swing of said at least one bucket to about 45° with respect to the axis of the drive shaft.

7. The centrifuge of claim 1, wherein the centrifuge further includes an actuating step pin and the lower cam defines a recess adapted to receive said step pin, thereby preventing rotation of the cams when the pin is received in the recess of the lower cam and allowing rotation only of the rotor.

8. A centrifuge having a selectable angle bucket type rotor, the centrifuge comprising:

a drive shaft having an axis, the shaft adapted for mounting and rotating the rotor;

drive means for rotating said drive shaft;

at least one bucket having an open lower end and adapted to carry a tube, the bucket being pivotably mounted on the periphery of the rotor and able to swing upwardly and outwardly during operation of the centrifuge;

a pivoting bracket that covers the lower end of the bucket and retains the tube therein;

an activated member for engaging and restraining the bracket;

so that the bracket moves away from the lower end of the bucket when said activated member engages the bracket and when the rotor is rotated in a first direction by the drive means, thereby allowing the tube to drop from the bucket.

9. The centrifuge set forth in claim 8 which also includes a tube guide positioned under said bucket, thereby to guide said tube when it drops from the bucket.

* * * * *